United States Patent [19]

Ueda

[11] Patent Number: 4,547,447

[45] Date of Patent: Oct. 15, 1985

[54] PHOTOSENSITIVE MEMBERS FOR ELECTROPHOTOGRAPHY CONTAINING PHTHALOCYANINE

[75] Inventor: Hideaki Ueda, Kishiwada, Japan

[73] Assignee: Minolta Camera Kabushiki Kaisha, Osaka, Japan

[21] Appl. No.: 628,299

[22] Filed: Jul. 6, 1984

Related U.S. Application Data

[63] Continuation-in-part of Ser. No. 513,043, Jul. 12, 1983, abandoned.

[30] Foreign Application Priority Data

| | | | |
|---|---|---|---|
| Jul. 14, 1982 | [JP] | Japan | 57-122361 |
| Jul. 16, 1982 | [JP] | Japan | 57-124839 |
| May 27, 1983 | [JP] | Japan | 58-94604 |
| Jun. 7, 1983 | [JP] | Japan | 58-102406 |

[51] Int. Cl.[4] ..... G03G 5/06

[52] U.S. Cl. ..... 430/78; 430/96

[58] Field of Search ..... 430/76, 78, 96

[56] References Cited

U.S. PATENT DOCUMENTS 3,672,889 6/1972 Baltazzi et al. .

FOREIGN PATENT DOCUMENTS

| | | | |
|---|---|---|---|
| 2362753 | 7/1974 | Fed. Rep. of Germany | 430/96 |
| 53-83744 | 7/1978 | Japan | 430/96 |
| 55-113051 | 9/1980 | Japan | 430/96 |

*Primary Examiner*—Roland E. Martin

*Attorney, Agent, or Firm*—Watson, Cole, Grindle & Watson

[57] ABSTRACT

A photosensitive member comprises a photosensitive layer which includes a phthalocyanine photoconductive material dispersed in a resin binder comprising a thermosetting acrylic resin containing hydroxyl groups or amide bond, and a melamine resin. Preferred mixing weight ratio of acrylic resin to melamine resin is about 95:5 to 40:60. Preferred phthalocyanine compounds are copper phthalocyanine, metal-free phthalocyanine and their derivatives.

5 Claims, 2 Drawing Figures

PHOTOSENSITIVE MEMBERS FOR ELECTROPHOTOGRAPHY CONTAINING PHTHALOCYANINE

REFERENCE TO RELATED APPLICATION

This application is a continuation-in-part application of U.S. patent application Ser. No. 06/513,043, filed July 12, 1983, now abandoned.

BACKGROUND OF THE INVENTION

1. Field of the Invention

The present invention relates to photosensitive members for electrophotography and, more particularly, to photosensitive members for electrophotography comprising a photosensitive layer formed on a conductive substrate, the photosensitive layer comprising a powdered photoconductive material dispersed in a binder of an insulating high molecular material.

2. Description of the Prior Art

In electrophotography, a photosensitive member is charged and then exposed to a light pattern to form a latent electrostatic image on a surface of its photosensitive layer, and the latent image is developed with a powder developer into a visible powder image, transferred to a sheet of suitable transfer paper such as plain paper, and then fixed thereon by fusing to form a copy. The photosensitive member is then cleaned and re-used for copying other subject matter. In a modified electrophotographic process, the latent image formed on the surface of the photosensitive layer is directly fixed on the photosensitive member by fusing to form a final print.

The photosensitive members for electrophotography are generally required to have various electrophotographic and physical properties. The important electrophotographic properties include photosensitivity, dark decay, residual potential, and fatigue in repeated use, and the physical properties include abrasion resistance and humidity resistance.

In commercial electrophotographic copying apparatuses, there have been employed photosensitive members utilizing amorphous selenium, cadmium sulfide or zinc oxide as a photoconductive material. The photosensitive members utilizing amorphous selenium are generally produced by depositing selenium on a surface of a conductive substrate with a plate or drum form. It is, however, difficult with selenium to produce photosensitive members with high quality because the properties of a selenium photosensitive layer may vary over a wide range, depending on the conditions of deposition. This causes a considerable increase in the manufacturing cost. Also, amorphous selenium photosensitive layers are poor in flexibility and require care in handling because of toxic properties of selenium.

The other photosensitive members utilizing zinc oxide or cadmium sulfide may be produced by coating on a surface of a substrate with a dispersion of a photoconductive material in an insulating resin binder. Such photosensitive members, generally called a binder-type, may vary in their electrophotographic properties, depending on an amount of the resin binder used. For example, the photosensitivity decreases with an increase in the amount of the used binder. It is therefore required to decrease the amount of the binder as much as possible. However, this causes a deterioration of physical properties including flexibility, surface smoothness, hardness and abrasion resistance of the photosensitive layers. Also, the binder-type photosensitive members become worse in electrophotographic properties due to the influence of ozone generated by corona discharging, and have a serious problem in sanitation in that there is a fear of environmental pollution because of toxic properties of cadmium and zinc oxide.

To overcome these disadvantages, there have been proposed various photosensitive members utilizing non-toxic organic photoconductive materials. For example, photosensitive members for electrophotography utilizing phthalocyanine and its compounds have been proposed and described in specifications of pending patent applications, for example, Japanese patent laid-open Nos. Sho 50-38543, 51-95852, 53-64040, 53-83744 and 54-147838. It is known that these photosensitive members have superior processing characteristics, high photosensitivity and possess no environmental pollution, and that they are highly sensitive even to light with a long wavelength, such as laser lights emitted from semiconductor lasers. These binder-type photosensitive members are greatly affected in the electrophotographic properties by the kinds of resin binder to be combined with phthalocyanines. It is therefore required to choose such a resin binder that does not cause deterioration of electrophotographic properties such as charging properties, photosensitivity, dark decay characteristics and reusability.

The resins conventionally used for the binder-type electrophotographic members are silicon resins, epoxy resins, alkyd resins, polyester resins, polycarbonate resins, vinyl resins, thermoplastic acrylic resins and urethane resins. However, such resins have been proved to be inadequate as a binder for production of photosensitive members utilizing phthalocyanine or its derivative. When the photosensitive layers are produced from phthalocyanines dispersed in the conventionally used resin, electrons generated in the layer are slow in being transported to the surface to the photosensitive layer for dissipation of surface charges, thereby requiring a relatively long time to form a latent image. This phenomenon is known as an induction effect and must be prevented from occurring when such a photosensitive layer is to be used for a high speed copying apparatus.

Also, when the conventionally used resins are employed as a binder for photosensitive members utilizing phthalocyanines, electrophotographic properties of the member deteriorate remarkably with increase of cycles of the repeated use. For example, the use of silicon resins provides low charging characteristics and the use of epoxy resins deteriorates photosensitivity. With urethane resins the members are low in the photosensitivity, but high in fatigue in repeated use, though they are high in the charge-discharge characteristics, dark decay characteristics and adhesive strength.

It has also been proposed to use thermoplastic acrylic resins as a binder for photosensitive members utilizing phthalocyanines. The combined use of thermoplastic acrylic resins and phthalocyanines enables the production of photosensitive members with better electrophotographic characteristics as compared with those utilizing conventional resins. However, it is difficult even with thermoplastic acrylic resins to prevent the member from the filming phenomenon that a toner film is formed on the surface of the member during the repeated use. This causes deterioration of the image qualities of prints. Also, it is not possible to obtain the electrophotographic properties and abrasion resistance sufficient for practical uses.

SUMMARY OF THE INVENTION

It is therefore an object of the present invention to provide improved photosensitive members for electrophotography utilizing phthalocyanines as a photoconductive material.

Another object of the present invention is to provide photosensitive members including phthalocyanines as a photoconductive material that possess improved electrophotographic properties, particularly, improved charging characteristics, high photosensitivity, good dark decay characteristics, low residual potential, and low fatigue in repeated cycles of the electrophotographic process.

Still another object of the present invention is to provide photosensitive members for electrophotography that have improved physical properties including high abrasion resistance and high humidity resistance.

These and other objects of the present invention can be achieved by providing a photosensitive member comprising a photosensitive layer which includes a phthalocyanine photoconductive material dispersed in binder resins of high molecular materials, the binder resins including at least thermosetting acrylic resin and melamine resin. The thermosetting acrylic resins are those containing hydroxyl groups in the branches of the molecule (hereinafter referred to as hydroxyl group-containing thermosetting acrylic resin) or those containing amide bonds in the branches of the molecule (hereinafter referred to as amide bond-containing thermosetting acrylic resin).

Preferred phthalocyanine photoconductive materials are copper phthalocyanines and derivatives thereof.

DETAILED DESCRIPTION OF THE INVENTION

Figure 1:
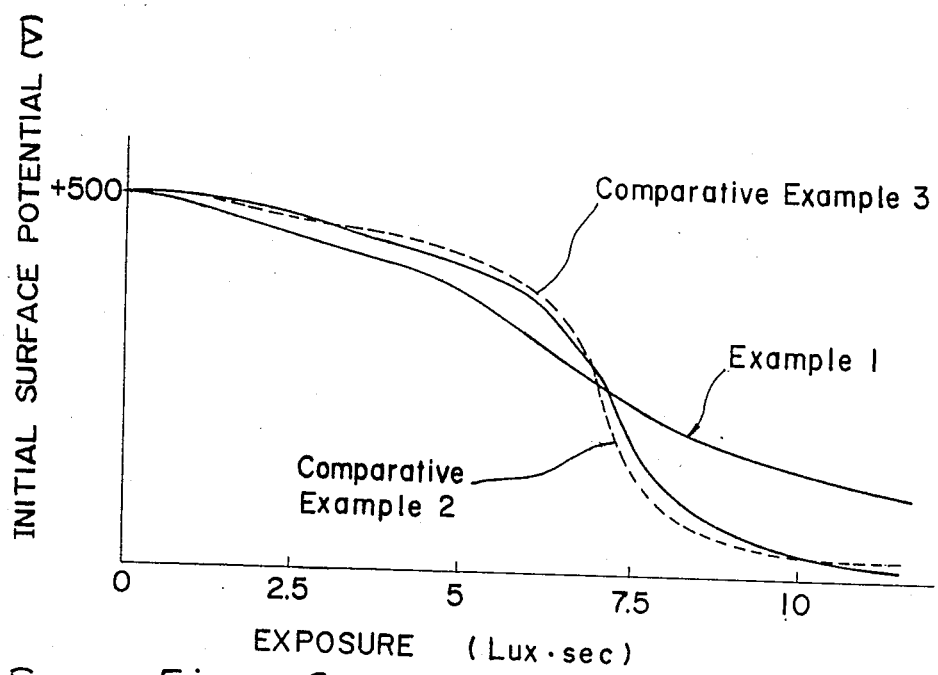
FIG. 1 and FIG. 2 are graphs showing dark decay characteristics of various photosensitive members as a function of exposure.

The photosensitive members for electrophotography according to the present invention may be produced by dispersing a powdered-photoconductive material of phthalocyanines into a solution of a resin binder dissolved in an organic solvent to form a dispersion of the photoconductive material, coating the resultant dispersion on a conductive substrate, and drying and curing the coating to form a photoconductive layer. If necessary, additives such as sensitizing agents may be dispersed into the dispersion of the photoconductive material. The photosensitive members of the present invention may have a protective layer on the photoconductive layer to prevent the latter from abrasion. Also, a charge transporting layer or photosensitive layer of any other photoconductive material may be provided on the photoconductive layer of phthalocyanines or between the substrate and the photosensitive layer of the phthalocyanines.

In accordance with the present invention, the resin binder includes at least thermosetting hydroxyl group- or amide bond-containing acrylic resin, and melamine resin.

With respect to the hydroxyl group-containing acrylic resin, the same is a random copolymer resin which can be produced by copolymerization of hydroxyalkyl (meth)acrylate with lower alkyl (meth)acrylate containing alkyl group with 1 to 12 carbon atoms and styrene and, if desired, further with one or more other polymerizable monomers having an unsaturated ethylenic coupling, i.e., an unsaturated carbon-to-carbon double bond.

The hydroxyalkyl (meth)acrylates, which are polymerizable monomers having a hydroxyl group, include those expressed by the general formula:

$$CH_2{=}\overset{\overset{\displaystyle X}{|}}{C}{-}COO{\leftarrow}RO{\rightarrow}_n H \qquad (1)$$

wherein X is hydrogen or methyl, R is alkylene containing 2 to 4 carbon atoms such as ethylene, propylene and butylene, and n is an integar of 1 to 3. The preferred hydroxyalkyl (meth)acrylates expressed by the general formula (1) include 2-hydroxyethyl methacrylate, 2-hydroxyethyl acrylate, 2-hydroxypropyl methacrylate, 2-hydroxypropyl acrylate, 3-hydroxypropyl methacrylate, 3-hydroxypropyl acrylate, diethylene glycol monomethacrylate, diethylene glycol monoacrylate, dipropylene glycol monomethacrylate, dipropylene glycol monoacrylate, tryethylene glycol monomethacrylate, triethylene glycol monoacrylate.

The lower alkyl (meth)acrylates includes those expressed by the general formula:

$$CH_2{=}\overset{\overset{\displaystyle X}{|}}{C}{-}COOR \qquad (2)$$

wherein X is hydrogen or methyl, R is lower alkyl containing 1 to 12 carbon atoms. The preferred lower alkyl (meth)acrylates expressed by the general formula (2) includes methyl methacrylate, methyl acrylate, ethyl methacrylate, ethyl acrylate, propyl methacrylate, propyl acrylate, butyl methacrylate, butyl acrylate, lauryl methacrylate, lauryl acrylate. These esters may be employed alone or in combination of any two or more.

The other polymerizable monomers containing an unsaturated carbon-to-carbon double bond includes water-soluble monomers such as acrylonitrile, methacrylonitrile, acrylamide, acrylic acid, methacrylic acid, crotonic acid, and maleic acid, α-methyl styrene, vinyl acetate, and vinyl propionate.

For the production of hydroxyl group-containing thermosetting acrylic resins, the hydroxyalkyl (meth)acrylate of the formula (1) may be employed in an amount ranging from 3 to 30 wt %, preferably, 5 to 20 wt % with respect to the amount of the other monomers. The hydroxyl number of the hydroxyl group-containing thermosetting acrylic resin is preferably 10 to 100. It is also preferred to use hydroxyl group-containing thermosetting acrylic resin with an acid value of 2 to 10.

In a preferred form, the above-described hydroxyl group-containing acrylic resin includes at least two of styrene, methyl methacrylate and n-butyl acrylate as primary monomers. These primary monomers are copolymerized with a polymerizable monomer having hydroxyl group and, if desired, further with one or more other polymerizable monomers having an unsaturated carbon-to-carbon double bond.

With respect to the amide bond-containing acrylic resin, it may be produced by copolymerization of a polymerizable amide monomer, lower alkyl (meth)a-crylate expressed by the above general formula (2), and styrene. Any other polymerizable monomer with an unsaturated carbon-to-carbon double bond may be used together with these monomers. The copolymerization may be carried out in the same manner as employed for the preparation of hydroxyl group-containing thermosetting acrylic resins.

The polymerizable amide monomers includes, without being limited to, acrylamide, methacrylamide, N-methylol acrylamide, N-n-butyl methyl acrylamide, and N-alkoxymethyl acrylamide.

As similarly with the hydroxyl group-containing acrylic resin, this amide bond-containing acrylic resin should preferably include at least two of styrene, methyl methacrylate and n-butyl acrylate as primary monomers. These primary monomers are copolymerized with a polymerizable amide monomer, i.e., a polymerizable monomer having an amide bond, and, if desired, further with the other polymerizable monomer having an unsaturated carbon-to-carbon double bond.

Either of the above thermosetting acrylic resins may be prepared by any of the well-known processes, for example, solution polymerization in which the reaction is carried out in a solvent. The thus prepared thermosetting acrylic resins are random copolymers. Preferred thermosetting acrylic resins are those having a mean molecular weight of 2000 to 40000 and a sharp distribution curve of the molecular weight. The copolymers with the molecular weight more than 40000 causes deterioration of the hardness of the photosensitive layer, thus making it not possible to improve the durability. The copolymers with the mean molecular weight less than 2000 causes the deterioration of the dark decay of the member, thus making it impossible to obtain electrophotographic properties sufficient for the practical use. The copolymers with a sharp distribution curve of the molecular weight enables to provide a uniformly crosslinked structure, thus making it possible to obtain high electron retention properties.

When solution-polymerized thermosetting acrylic resins are used as it is, it is preferred to use a resin solution with a viscosity of 200 to 3000 cps in a 50% solution. The use of the resin solution with a viscosity more than 3000 cps results in the deterioration of the dispersing qualities of the photoconductive materials, and the resin solution with a viscosity less than 200 cps causes the deterioration of the photosensitivity and application properties.

Any of melamine resins may be used as a component of the binder. The melamine resins include, without being limited to, butylated melamine resins, methylated melamine resins, butylated benzoguanamine resins, methylated benzoguanamine resins. Among them the butylated melamine resins are preferred to use as a binder component.

Any of epoxy resins may be used as a binder in combination with thermosetting acrylic resin and melamine resin.

The preferred mixing ratio between the acrylic resin and melamine resin ranges from 95:5 to 40:60, particularly, from 90:10 to 50:50 in the weight ratio. When epoxy resin is added to form a binder of a ternary system, the content of the epoxy resin is 2 to 20 parts by weight, preferably, 2 to 15 parts by weight with respect to 100 parts by weight of hydroxyl group-containing thermosetting acrylic resin.

Any phthalocyanine or its derivative may be used as a phthalocyanine photoconductive material. The derivatives of phthalocyanine include metal phthalocyanines, metal-free phthalocyanines, complex compounds of phthalocyanines and the like. The metal phthalocyanines include, without being limited to, aluminum phthalocyanine, vanadium phthalocyanine, tin phthalocyanine, antimony phthalocyanine, barium phthalocyanine, berylium phthalocyanine, cobalt phthalocyanine, cobalt 4-chloro phthalocyanine, copper phthalocyanine, copper-4-amino-phthalocyanine, copper-4-chloro phthalocyanine, dysprosium phthalocyanine, germanium phthalocyanine, holmium phthalocyanine, iron phthalocyanine, iron-polyhalogenated phthalocyanine, lead polychloro phthalocyanine, cobalt hexaphenyl phthalocyanine, platinum phthalocyanine and zinc phthalocyanine.

The metal-free phthalocyanines include, without being limited to, dialkylamino phthalocyanine, tetraazo phthalocyanine, tetramethyl phthalocyanine, and tetraphenyl phthalocyanine.

Additionally, the phthalocyanine photoconductive material further includes a photoconductive material which comprises a phthalocyanine and a phthalocyanine derivative in which the phthalocyanine molecule has a benzene nuclei substituted with at least one electron attractive group selected from nitro group, cyano group, halogen atoms, sulphonyl and carboxyl groups. To be specific, such a photoconductive material can be prepared by mixing a phthalocyanine derivative in which at least one hydrogen atom of the benzene nuclei of a phthalocyanine molecule is substituted with at least one member of an electron attractive group selected from the group consisting of nitro group, cyano, halogen atoms, sulphonyl and carboxy groups, and a phthalocyanine with an inorganic acid capable of forming a salt with the phthalocyanines, and precipitating the mixture with water or basic material. As the electron attractive group- substituted phthalocyanine derivatives, there may be used those having the number of the substituents in one molecule of generally in the range of 1 to 16, and preferably, 1 to 8. Also, the composition ratio of the electron attractive group-substituted phthalocyanine derivative of the other non-substituted phthalocyanine is such that the number of substituted group of the former is 0.001 to 2, preferably, 0.002 to 1 per unit molecule o f phthalocyanine. As the inorganic acids capable of forming a salt with the phthalocyanines, there may be used those such as sulfuric acid, orthophosphoric acid, chlorosulphonic acid, hydrochloric acid, hydroiodic acid, hydrofluoric acid, and hydrobromic acid.

These phthalocyanine and phthalocyanine derivatives may be used alone or in combination. Among these phthalocyanine photoconductive materials, preferred phthalocyanine compounds are metal-free phthalocyanines, copper phthalocyanines and their derivatives such as halogen derivatives of copper phthalocyanines.

The content of the phthalocyanine photoconductive material in the photosensitive layer is 15 to 120 parts by weight, preferably, 25 to 100 parts by weight, with respect to 100 parts by weight of the binder. The higher the content of the phthalocyanine photoconductive material, higher the photosensitivity of the member. However, the content of the phthalocyanine photoconductive material higher than that maximum value causes a considerable increase of the dark decay rate, resulting in a considerable lowering of the ability to retain electrical charges, thus making it not possible to put the photosensitive members into practical use. In contrast therewith, the dark decay rate may be decreased by reducing the content of the phthalocyanine photoconductive material. If the content is less than that minimum value, the photosensitivity become considerably lowered.

As a conductive substrate of the photosensitive members, there may be used those such as copper, aluminum, iron, silver and nickel in a sheet, plate or drum form.

According to the photosensitive member of the present invention, the induction effect inherent in the photosensitive layer using phthalocyanine becomes quite small and images of excellent half tone can be obtained for a long run as its sensitivity is quite stable in a continuous copying. Moreover, the photosensitive member has excellent physical properties such as humidity resistance and durability.

The invention will be further apparent from the following description with reference to the examples thereof.

EXAMPLE 1

For production of a hydroxyl group-containing thermosetting acrylic resin, 60 parts by weight of cellosolve acetate (Trademark of UCC), 40 parts by weight of toluene and 0.4 parts by weight of azobisisobutyronitryl were weighed and placed in a four neck distillation flask with a 1 liter internal volume provided with a stirrer and a condenser, and then nitrogen gas was introduced into the flask. The mixed solution was heated under stirring and maintained at about 80° C. To this mixed solution a mixture of 22 parts by weight of methyl methacrylate, 40 parts by weight of styrene, 25.5 parts by weight of butyl acrylate, and 11.5 parts by weight of 2-hydroxyethyl methacrylate was added dropwise over a period of 8 hours to carry out the copolymerization of the above monomers. There was obtained a colorless, clear solution of hydroxyl group-containing thermosetting acrylic resin with a viscosity of 1000 cps. at 25° C. containing a 50% nonvolatile matter. The mean molecular weight of the resin was 18500.

Using the resultant thermosetting acrylic resin and melamine resin, Super Bekkamin J820 (Trademark of Dainippon Ink Co., Ltd.), as a binder, there was prepared a photoconductive coating composition in the following manner. 32 parts by weight of the thermosetting acrylic resin and 8 parts by weight of Super Bekkamin J820 were placed in a ball mill pot together with 0.5 parts by weight of 2,4,5,7-tetranitrofluorenone, 20 parts by weight of ε-copper phthalocyanine (made by Toyo Ink Co., Ltd), 50 parts by weight of a mixed solvent of butyl acetate, cellosolve acetate and n-butyl alcohol in the weight ratio of 2:2:1, and milled for 30 hours. The thus prepared photoconductive coating composition was applied on an aluminum substrate in a drum form, dried and then cured by heating to produce a photosensitive layer with a 10 micron thick, thereby preparing a photosensitive drum for electrophotography.

EXAMPLE 2

Hydroxyl group-containing theremosetting acrylic resin was prepared in the same manner as described in Example 1, using the following materials.

cellosolve acetate: 60 parts by weight
toluene: 40 parts by weight
azobisisobutyronitrile: 0.4 parts by weight
butyl acrylate: 28 parts by weight
acrylic acid: 2 parts by weight
styrene: 60 parts by weight
2-hydroxyethyl methacrylate: 10 parts by weight The resultant hydroxyl group-containing thermosetting acrylic resin solution has a viscosity of 1600 cps. at 25° C. The mean molecular weight of the resin was 16800.

Using 34 parts by weight of the thus prepared thermosetting acrylic resin and 6 parts by weight of Super Bekkamin J820(melamine resin) as a binder, a photoconductive coating composition was prepared by mixing the binder, in a ball mill pot for 30 hours, with 15 parts by weight of ε-copper phthalocyanine and 50 parts by weight of a mixed solvent of butyl acetate, cellosolve acetate and n-butyl alcohol in the weight ratio of 2:2:1. The thus prepared coating composition was applied on an aluminum drum, dried and then cured by heating to form a photosensitive drum having a photosensitive layer of a 10 micron thick.

EXAMPLE 3

Hydroxyl group-containing thermosetting acrylic resin was prepared in the same manner as described in Example 1, using the following materials.

cellosolve acetate: 60 parts by weight
toluene: 40 parts by weight
azobisisobutyronitrile: 0.4 parts by weight
styrene: 50 parts by weight
methyl methacrylate: 20 parts by weight
ethyl acrylate: 3 parts by weight
butyl acrylate: 10 parts by weight
methacrylic acid: 2 parts by weight
2-hydroxypropyl methacrylate: 15 parts by weight The resultant hydroxyl group-containing thermosetting acrylic resin solution has a viscosity of 750 cps. at 25° C. The mean molecular weight of the resin was 25000.

Using the thus prepared thermosetting acrylic resin together with melamine resin, a photoconductive coating composition was prepared in the same manner as in Example, 2. That is, in the composition of the photoconductive coating composition of Example 2, the thermosetting acrylic resin prepared in Example 2 was replaced with the same amount of the above prepared thermosetting acrylic resin. The resultant coating composition was applied on a surface of an aluminium substrate, dried and then cured by heating to prepare a photosensitive drum having a photoconductive layer with a thickness of 10 microns.

EXAMPLE 4

Hydroxyl group-containing thermosetting acrylic resin was prepared in the same manner as in Example 1, using the following materials.

cellosolve acetate: 60 parts by weight
toluene: 40 parts by weight
azobisisobutyronitrile: 0.4 parts by weight
styrene: 50 parts by weight
methyl methacrylate: 20 parts by weight
ethyl acrylate: 3 parts by weight
butyl acrylate: 10 parts by weight
acrylic acid: 4 parts by weight
2-hydroxyethyl methacrylate: 9 parts by weight There was obtained hydroxyl group-containing thermosetting acrylic resin solution with a viscosity of 750 cps. at 25° C. The mean molecular weight of the resin was 25000.

Using the thus prepared thermosetting acrylic resin together with melamine resin as a binder, a photoconductive coating composition was prepared in the same manner as described in Example 2. That is, in the composition of the photoconductive coating composition, the thermosetting acrylic resin prepared in Example 2 was replaced with the same amount of the above prepared thermosetting acrylic resin. The resultant coating composition was applied on a surface of an aluminum substrate, dried and then cured by heating to form a photosensitive drum having a photoconductive layer with a thickness of 10 microns.

COMPARATIVE EXAMPLE 1

A photoconductive coating composition was prepared in the same manner as in Example 1 but using a binder of 32 parts by weight of thermosetting acrylic resin prepared in Example 1, and 8 parts by weight of epoxy resin, Epikote 1001 (Trademark, Shell International Chemicals Corp.) in place of the binder of thermosetting acrylic resin and melamine resin in Example 1. Using this coating composition, a photosensitive drum for electrophotography was prepared in the same manner as in Example 1.

COMPARATIVE EXAMPLE 2

A photoconductive coating composition was prepared in the same manner as in Example 1 but using, as a binder, 30 parts by weight of thermosetting acrylic resin prepared in Example 1, and 10 parts by weight of isocyanate, Desmodur N-75 (Trademark, Farbenfabriken Bayer A.G.) in place of the binder consisting of thermosetting acrylic resin and melamine resin. Using this composition, a photosensitive drum for electrophotography was prepared in the same manner as in Example 1.

COMPARATIVE EXAMPLE 3

A photoconductive coating composition was prepared in the same manner as in Example 1 but using, as a binder, only 48 parts by weight of thermosetting acrylic resin prepared in Example 1, in place of the binder of thermosetting acrylic resin and melamine resin. Using this composition, a photosensitive drum for electrophotography was prepared in the same manner as in Example 1.

COMPARATIVE EXAMPLE 4

A photoconductive coating composition was prepared in the same manner as in Example 1 but using, as a binder, only 40 parts by weight of melamine resin (Super Bekkamin J820) in place of the binder used therein comprising thermosetting acrylic resin prepared in Example 1 and melamine resin. Using this coating composition, a photosensitive drum for electrophotography was prepared in the same manner as in Example 1.

EXAMPLE 5

For preparation of a composition of a phthalocyanine photoconductive material, 40 parts by weight of copper phthalocyanine and 0.5 parts by weight of dinitrophthalocyanine were dissolved in 500 parts by weight of 98% concentrated sulfuric acid under stirring. The resultant solution was poured into 2000 parts by weight of water to precipitate a composition of copper phthalocyanine and dinitrophthalocyanine, and the precipitate was filtered off, washed with water and then dried at 120° C. under a reduced pressure.

Using the resultant phthalocyanine composition, photoconductive coating composition was prepared in the following manner: 10 parts by weight of the phthalocyanine composition is placed in a ball-mill together with 24 parts by weight of hydroxyl group-containing thermosetting acrylic resin (Acrydic A801, Trademark, Dainippon Ink Co., Ltd.), 6 parts by weight of melamine resin(Super Bekkamin J820), 100 parts by weight of a mixed solvent of butyl acetate and cellosolve acetate in the weight ratio of 1:1, and the mixture was ball-milled for 30 hours.

A photosensitive drum for electrophotography was prepared by applying the resultant coating composition on an aluminum substrate in a drum form, drying the same, and then curing by heating to form a photosensitive layer with a thickness of 10 microns on the substrate drum.

EXAMPLE 6

A photoconductive coating composition was prepared in the same manner as in Example 5 but using, as a binder, hydroxyl group-containing thermosetting acrylic resin prepared in Example 1 in place of the thermosetting acrylic resin employed in Example 5. Using this coating composition, a photosensitive drum was prepared in the same manner as in Example 5.

COMPARATIVE EXAMPLE 5

A photoconductive coating composition was prepared in the same manner as in Example 5 but using, as a binder, 24 parts by weight of thermosetting acrylic resin (Acrydic A801) employed in Example 5, and 8 parts by weight of isocyanate, Desmodur N-75 (Trademark, Farbenfabriken Bayer A.G.) in place of the binder employed in that example. Using this coating composition, a photosensitive drum was prepared in the same manner as in Example 5.

COMPARATIVE EXAMPLE 6

A photoconductive coating composition was prepared in the same manner as in Example 5 but using, as a binder, 24 parts by weight of thermosetting acrylic resin (Acrydic A801) employed in Example 5, and 6 parts by weight of epoxy resin (Epikote 1007, Trademark, Shell International Chemicals Corp.) in place of the binder employed in that example. Using this coating composition, a photosensitive drum was prepared in the same manner as in Example 5.

COMPARATIVE EXAMPLE 7

A photoconductive coating composition was prepared in the same manner as in Example 5 but using, as a binder, 30 parts by weight of thermoplastic acrylic resin (OXL-97) in place of 24 parts by weight of Acrydic A801 employed in that example. Using this coating composition, a photosensitive drum was prepared in the same manner as in Example 5.

COMPARATIVE EXAMPLE 8

A photoconductive coating composition was prepared in the same manner as in Example 5 but using, as a binder, only 30 parts by weight of thermosetting acrylic resin (Acrydic A801)employed in Example 5 in place of the binder resins employed in that example. Using this coating composition, a photosensitive drum was prepared in the same manner as in Example 5.

Each of the fourteen photoconductive drums prepared in Examples 1 to 6 and Comparative Examples 1 to 8 was assembled in a commercial electrophotographic copying apparatus of a powder-image transfer system, and then subjected to measurements of the electrostatic properties. The first initial surface potential ($V_0$) of each drum was set to 500 V by corona discharging generated by applying a DC voltage of +6.5 kv. The measurements were made with respect to an exposure ($E_{\frac{1}{2}}$(Lux. sec)) required for reducing the first initial surface potential of 500 V to 250 V, an initial surface potential ($V_0$(v)) of the drum just after charging for the thousandth time in continuous cycles of the electrophotographic process, and surface potentials of the drum ($V_i$(V)) just after the first and thousandth exposures when the electrophotographic process is repeated 1000 times under the conditions that the drum is subjected to an exposure by which the first initial surface potential of the drum, i.e., 500 V, is reduced to 300 V.

A difference between the first and thousandth initial surface potentials, ($\Delta V_0$(V)), and a difference between the surface potentials ($\Delta V_i$(v)) measured just after the first and thousandth exosures were determined.

The results are shown in Table 1. The dark decay curves for the drums of Example 1 and Comparative Examples 2 and 3 are shown in FIG. 1.

TABLE 1

| | $E_{\frac{1}{2}}$ (Lux · sec) | $\Delta V_0$ (V) | $\Delta V_i$ (V) |
|---|---|---|---|
| Example 1 | 7.2 | 0 | +2 |
| Example 2 | 7.3 | +1 | −1 |
| Example 3 | 7.0 | +2 | +5 |
| Example 4 | 7.2 | +1 | +4 |
| Comparative Example 1 | 25.8 | +2 | −3 |
| Comparative Example 2 | 7.2 | −50 | −100 |
| Comparative Example 3 | 7.0 | −30 | −60 |
| Comparative Example 4 | 28.0 | +1 | +10 |
| Example 5 | 2.4 | +3 | +2 |
| Example 6 | 2.3 | 0 | −2 |
| Comparative Example 5 | 2.2 | −30 | −150 |
| Comparative Example 6 | 10.0 | −5 | +10 |
| Comparative Example 7 | 6.8 | −20 | +30 |
| Comparative Example 8 | 2.2 | −20 | −80 |

In the Table, the positive sign for $\Delta V_0$ and $\Delta V_i$ shows the increase of the surface potential of the photosensitive drum, while the negative sign shows the decrease of its surface potential.

As will be seen from the results in Table 1, the photosensitive drums of the present invention are considerably small in the change of the initial potential, compared with those of comparative examples. This means that the photosensitive members of the present invention are small in fatigue even when subjected to repeated cycles of charging and exposure. Also, it will be seen that the photosensitive drums of the present invention are reduced in the induction effect since the change of surface potential ($\Delta$Vi(V)) is small. From the FIG. 1, it will be seen that the photosensitive drum of the present invention possesses a gently sloping dark decay curve. This means that the photosensitive members of the present invention have good dark decay characteristics, thus making it possible to obtain electrophotographic prints with good tone characteristics and line copy reproducibility.

EXAMPLE 7

Hydroxyl group-containing thermosetting acrylic resin was prepared, using a composition of the following components.

styrene: 200 parts by weight
methyl methacrylate: 160 parts by weight
n-butyl acrylate: 75 parts by weight
β-hydroxypropyl acrylate: 55 parts by weight
maleic acid: 8 parts by weight
benzoyl peroxide: 7.5 parts by weight
ethylene glycol monomethyl ether: 150 parts by weight The above composition was added dropwise over a period of 2 hours to 350 parts by weight of xylene contained in a reaction vessel kept at 105° C. in nitrogen atmosphere. After 2.5 hours from the initiation of polymerization, the reaction system was further added with 0.5 parts by weight of benzoyl peroxide, polymerized for 8 hours at that temperature under stirring. There was obtained hydroxyl group-containing thermosetting acrylic resin solution with a viscosity of 800 cps. at 25° C. and containing 50% nonvolatile matter.

Using 34 parts by weight (nonvolatile matter) of the thus prepared thermosetting acrylic resin and 6 parts by weight of Super Bekkamin J820 as a binder, a photoconductive coating composition was prepared by placing and mixing the binder for 30 hours in a ball mill together with 0.5 parts by weight of 2,4,5,7-tetranitro-9-fluorenon, 20 parts by weight of ε-copper phthalocyanine (made by Toyo Ink Co., Ltd.), 40 parts by weight of cellosolve acetate, and 40 parts by weight of methyl ethyl ketone. The resultant coating composition was applied on a surface of an aluminium substrate drum, dried and then cured by heating to form a photosensitive drum having a photosensitive layer with a thickness of 8 microns.

EXAMPLE 8

A photoconductive coating composition was prepared in the same manner as in Example 7 by mixing 28 parts by weight of the hydroxyl group-containing thermosetting acrylic resin prepared in Example 7, 20 parts by weight of ε-copper phthalocyanine, 12 parts by weight of melamine resin (Melan 20, Trademark, Hitachi Chemicals Co., Ltd), and 0.5 parts by weight of 2,4,5,7-tetranitro-9-fluorenon.

Using the resultant coating composition, a photosensitive drum was prepared in the same manner as in Example 7.

COMPARATIVE EXAMPLE 9

In the photoconductive coating composition of Example 7, the binder was replaced with only 40 parts by weight of the hydroxyl group-containing thermosetting acrylic resin prepared in that example. Using the resultant coating composition, a photosensitive drum for electrophotography was prepared in the same manner as described in Example 7.

COMPARATIVE EXAMPLE 10

In the photoconductive coating composition of Example 7, the binder was replaced with only 40 parts by weight of Supper Bekkamin J820A. Using the resultant coating composition, a photosensitive drum for electrophotography was prepared in the same manner as described in Example 7.

COMPARATIVE EXAMPLE 11

In the photoconductive coating composition of Example 7, the binder of the hydroxyl group-containing thermosetting acrylic resin and melamine resin was replaced with 40 parts by weight of thermoplastic acrylic resin, OXL-97. Using the resultant coating composition, a photosensitive drum for electrophotography was prepared in the same manner as described in Example 7.

EXAMPLE 9

A photoconductive coating composition was prepared in the same manner as in Example 7, using a composition composed of 20 parts by weight of metal-free phthalocyanine, 1 part by weight of 2,4,7-trinitro-9-fluorenon, 34 parts by weight (nonvolatile matter) of the hydroxyl group-containing thermosetting acrylic resin prepared in Example 7, and 6 parts by weight of Supper Bekkamin J820.

Using the resultant coating composition, a photosensitive drum for electrophotography was prepared in the same manner as in Example 7.

EXAMPLE 10

For preparation of a composition of a phthalocyanine photoconductive material, 40 parts by weight of copper phthalocyanine and 0.2 parts by weight of tetranitrophthalocyanine were dissolved in 800 parts by weight of 98% concentrated sulfuric acid under stirring. The resultant solution was poured into 6000 parts by weight of water to precipitate a composition of copper phthalocyanine and tetranitrophthalocyanine, and the precipitate was filtered off, washed with water and then dried at 120° C. under a reduced pressure.

Using the resultant phthalocyanine composition, a photoconductive coating composition was prepared in the following manner: 12 parts by weight of the phthalocyanine composition was placed in a ball-mill together with 36 parts by weight of the hydroxyl group-containing thermosetting acrylic resin prepared in Example 7, 4 parts by weight of Super Bekkamin J820, and 100 parts by weight of a mixed solvent of butyl acetate and cellosolve acetate in the weight ratio of 1:1, and the mixture was ball-milled for 30 hours.

Using the resultant coating composition, a photosensitive drum for electrophotography was prepared in the same manner as in Example 7.

EXAMPLE 11

Amide bond-containing thermosetting acrylic resin was prepared in the same manner as in Example 7, using a composition of the following components.

styrene: 30 parts by weight
methyl methacrylate: 20 parts by weight
methylated acrylamide: 15 parts by weight
n-butyl acrylate: 20 part by weight
ethyl acrylate: 13 parts by weight
maleic acid: 2 parts by weight A photoconductive coating composition was prepared by using 34 parts by weight of the thus prepared thermosetting acrylic resin and 6 parts by weight of Super Bekkamin J820 as a binder, and mixing the same in a ball mill pot for 30 hours together with 0.5 parts by weight of 2,4,5,7-tetranitro-9-fluorenon, 12 parts by weight of copper phthalocyanine-tetranitro-copper phthalocyanine complex prepared in Example 10, 40 parts by weight of cellosolve acetate and 40 parts by weight of methyl ethyl ketone.

Using the resultant coating composition, a photosensitive drum for electrophotographic was prepared in the same manner as in Example 7.

COMPARATIVE EXAMPLE 12

Thermosetting acrylic resin was prepared in the same manner as in Example 11, by using a mixture of styrene, ethyl acrylate, and acrylic acid in the weight ratio of 72:20:8 as starting monomers. Using 34 parts by weight of the thus prepared thermosetting acrylic resin in place of amide bond-containing thermosetting acrylic resin used in Example 11, a photoconductive coating composition was prepared in the same manner as in Example 11.

Using the resultant coating composition, a photosensitive drum for electrophotography was prepared in the same manner as in Example 7.

COMPARATIVE EXAMPLE 13

Thermosetting acrylic resin was prepared in the same manner Example 7, using a mixture of the following components as starting monomers.

styrene: 35 parts by weight
methyl acrylate: 40 parts by weight
acrylic acid: 5 parts by weight
glycidyl methacrylate: 5 parts by weight
butyl acrylate: 15 parts by weight In the photoconductive coating composition of Example 11, the amide bond-containing thermosetting acrylic resin was replaced with the above resultant thermosetting acrylic resin to form a photoconductive coating composition.

Using the resultant coating composition, a photosensitive drum for electrophotography was prepared in the same manner as in Example 7.

COMPARATIVE EXAMPLE 14

In the composition of the photoconductive coating composition of Example 11, the binder used therein was replaced with 34 parts by weight of thermosetting acrylic resin (Acrydic A801), and 6 parts by weight of isocyanate, Desmodule N-75, to prepare a photoconductive coating composition.

Using the resultant coating composition, a photosensitive drum for electrophotography was prepared in the same manner as in Example 7.

COMPARATIVE EXAMPLE 15

In the composition of the photoconductive coating composition of Example 11, the melamine resin used therein was replaced with 6 parts by weight of epoxy resin, Epikote 1007, to prepare a photoconductive coating composition.

Using the resultant coating composition, a photosensitive drum for electrophotography was prepared in the same manner as in Example 7.

Each of the twelve photoconductive drums prepared in Examples 7 to 11 and Comparative Examples 9 to 14 was assembled in a commercial electrophotographic copying apparatus of a powder-image transfer system, and then subjected to measurements of the electrostatic properties, i.e., an exposure ($E_{\frac{1}{2}}$(Lux.sec)) required for reducing the surface potential ($V_0$) of 500 V to 250 V, a change of the initial surface potentials ($\Delta V_0$(V)) when the electrophotographic process is repeated 1,000 times, and a change of the surface potential by exposure ($\Delta V_i$(V)) when the electrophotographic process is repeated 1,000 times under the condition that the drum is exposed to a certain exposure by which the first initial surface potential is reduced to 300 V ($V_i$). Also, $V_5$, a surface potential in dark after elapse of 5 seconds from charging to $V_0$, was determined.

Figure 2:
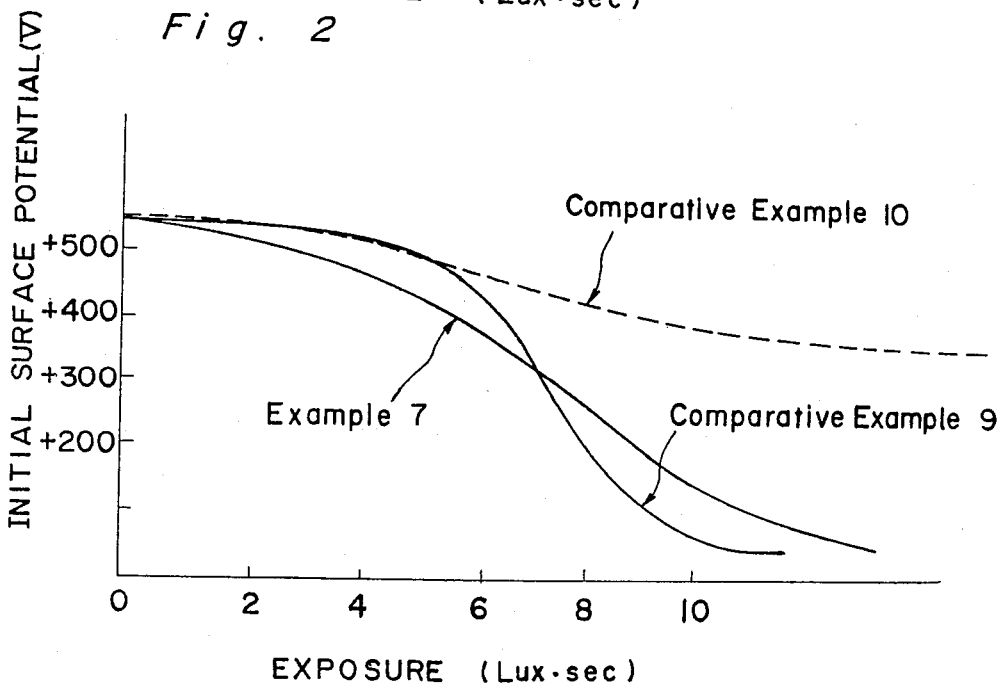

The results are shown in Table 2. The dark decay curves for the drums of Example 7 and Comparative Examples 9 and 10 are shown in FIG. 2.

TABLE 2

| | $V_0$ (V) | $V_5$ (V) | $E_{\frac{1}{2}}$ (Lux · sec) | $\Delta V_0$ (V) | $\Delta V_i$ (V) |
|---|---|---|---|---|---|
| Example 7 | 540 | 490 | 7.3 | 0 | −10 |
| Example 8 | 535 | 480 | 7.4 | −5 | −0 |
| Comparative Example 9 | 540 | 470 | 7.3 | −20 | −50 |
| Comparative Example 10 | 550 | 510 | 22.0 | 0 | +10 |
| Comparative Example 11 | 535 | 470 | 10.5 | −30 | −60 |
| Example 9 | 540 | 485 | 15.6 | −10 | −5 |
| Example 10 | 545 | 490 | 3.2 | 0 | 0 |
| Example 11 | 540 | 480 | 3.5 | −5 | −5 |
| Comparative Example 12 | 515 | 320 | 2.9 | −100 | −130 |
| Comparative Example 13 | 540 | 495 | 10.5 | −5 | +20 |
| Comparative Example 14 | 535 | 485 | 3.4 | −40 | −150 |
| Comparative Example 15 | 540 | 500 | 16.5 | −5 | +50 |

In the Table, the positive sign for $\Delta V_0$ and $\Delta V_i$ shows the increase of the surface potential of the drums, and the negative sign shows the decrease of the surface potential.

As will be seen from the results in Table 2, the photosensitive drums of the present invention are superior in the electrostatic properties and the photosensitivity to those of comparative examples. From the FIG. 2, it will be seen that the photosensitive drum of the present invention possesses a gently sloping dark decay curve, thus making it possible to obtain electrophotographic prints with good tone characteristics and line print reproducibility.

As will be seen from the results in Table 1, the photosensitive drums of the present invention are considerably small in the change of the initial potential, compared with those of comparative examples. This means that the photosensitive members of the present invention are small in fatigue even when subjected to repeated cycles of charging and exposure. Also, it will be seen that the photosensitive drums of the present invention are reduced in the induction effect since the change of surface potential ($\Delta$Vi(V)) is small. From the FIG. 1, it will be seen that the photosensitive drum of the present invention possesses a gently sloping dark decay curve. This means that the photosensitive members of the present invention have good dark decay characteristics, thus making it possible to obtain electrophotographic prints with good tone characteristics and line copy reproducibility.

What I claim is:

1. A photosensitive member comprising a photosensitive layer which includes phthalocyanine photoconductive material dispersed in a resin binder, said binder including a thermosetting acrylic resin containing hydroxyl groups or amide bonds, and a melamine resin, the mixing weight ratio of said acrylic resin to malamine resin being about 95:5 to 40:60, and said phthalocyanine photoconductive material being included in the photosensitive layer in an amount of 15 to 100 parts by weight with respect to 100 parts by weight of said binder.

2. A photosensitive member comprising a photosensitive layer which includes a photoconductive material of phthalocyanine compound dispersed in a binder of high molecular material, said binder including melamine resin and a thermosetting acrylic resin containing hydroxyl groups in the branches of the molecule, the mixing weight ratio of said acrylic resin to melamine resin being about 95:5 to 40:60, and said phthalocyanine photoconductive material being included in the photosensitive layer in an amount of 15 to 100 parts by weight with respect to 100 parts by weight of said binder.

3. A photosensitive member as claimed in claim 2 wherein said phthalocyanine compound is selected from the group consisting of copper phthalocyanine, metal-free phthalocyanine and their derivatives.

4. A photosensitive member comprising a photosensitive layer which includes a phthalocyanine compound dispersed in a binder, said binder including a melamine resin and a thermosetting acrylic resin containing hydroxyl groups or amide bonds and a copolymer formed from at least two components selected from the group consisting of styrene, methyl methacrylate and n-butyl acrylate, the mixing ratio of said acrylic resin to melamine resin being about 95:5 to 40:60, and said phthalocyanine photoconductive material being included in the photosensitive layer in an amount of 15 to 100 parts by weight with respect to 100 parts by weight of said binder.

5. A photosensitive member comprising a photosensitive layer which includes a phthalocyanine photoconductive material dispersed in a binder, said photoconductive material including a phthalocyanine and a phthalocyanine derivative in which the phthalocyanine molecule has a benzene nuclei substituted with at least one electron attractive group selected from the group consisting of nitro group, cyano group, halogen atoms, sulphonyl and carboxyl groups, said binder including a thermosetting acrylic resin containing hydroxyl groups or amide bond, and a melamine resin, the mixing weight of said acrylic resin to melamine resin being about 95:5 to 40:60, and said phthalocyanine photoconductive material being included in the photosensitive layer in an amount of 15 to 100 parts by weight with respect to 100 parts by weight of said binder.

* * * * *